US006280237B1

(12) United States Patent
Saka et al.

(10) Patent No.: US 6,280,237 B1
(45) Date of Patent: Aug. 28, 2001

(54) CONNECTOR

(75) Inventors: Yukinori Saka; Masamitsu Chishima, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/652,402

(22) Filed: Aug. 31, 2000

(30) Foreign Application Priority Data

Sep. 10, 1999 (JP) ..... 11-256890

(51) Int. Cl.[7] ..... H01R 3/00
(52) U.S. Cl. ..... 439/489; 489/271
(58) Field of Search ..... 439/489, 354, 439/271, 352; 174/77 R, 65 G, 65 SS

(56) References Cited

U.S. PATENT DOCUMENTS 6,024,595 * 2/2000 Saba et al. ..... 439/489
6,045,403 * 4/2000 Werner et al. ..... 174/65 SS
6,109,956 * 8/2000 Kawase et al. ..... 439/489

FOREIGN PATENT DOCUMENTS 0 896 386 2/1999 (EP) .

* cited by examiner

*Primary Examiner*—Renee Luebke
*Assistant Examiner*—Felix O. Figueroa
(74) *Attorney, Agent, or Firm*—Anthony J. Casella; Gerald E. Hespos

(57) ABSTRACT

A female housing 20 is provided with a terminal accommodating portion 21 for accommodating female terminal fittings 24, a rubber ring 33 to be adhered to the inner circumferential surface of a receptacle of a male housing 10 to be connected with 20 is fitted on the outer circumferential surface of the terminal accommodating portion 21 and a spring holder 50 accommodating coil springs 60 provided with spring pressing members 59 at their front ends is mounted between the terminal accommodating portion 21 and an outer tubular portion 23. The rubber ring 33 is movable from a temporary mount position where a clearance is formed between the inner surface thereof and the outer surface of a locking portion 31 of the retainer 30 to a proper mount position where it is adhered to the terminal accommodating portion 21 over an entire circumference as the housings 10, 20 are connected with each other. Before connection, the spring members 59 of the spring holder 50 are in contact with the rear surface of the rubber ring 33 located in its temporary mount position.

10 Claims, 14 Drawing Sheets

CONNECTOR

BACKGROUND OF THE INVENTION

1. Field of the Invention

The present invention relates to a connector with a partial connection detecting function and a water preventing function.

2. Description of the Related Art

Prior art connectors that are used in essential circuits of an airbag or like device are provided with a means for preventing a partial connection of female and male connectors to prevent an erroneous operation of the device. One such prior art connector is disclosed in Japanese Unexamined Patent Publication No. 11-111390 and is shown in FIG. 19 of this application. The prior art connector of FIG. 19 includes a female housing 1. A spring unit 2 is disposed in the female housing 1 and comprises a coil spring 2A and a spring pressing member 2B. The prior art connector further includes a male housing 4. The male housing 4 includes a receptacle 5, and a rib 5A projects from an outer surface of the receptacle 5. When the connection of the housings 1 and 4 is started, the rib 5A pushes the spring pressing member 2B to gradually compress the coil spring 2A. If the connecting operation is interrupted halfway, the housings 1 and 4 are separated by a spring force accumulated in the coil spring 2A, thereby preventing the housings 1 and 4 from being held in a partly connected condition.

Some of the above-described prior art connectors also must be watertight. To achieve a watertight connection, a rubber ring 6 is fitted on the outer circumferential surface of a back end of an inner tubular portion 3 of the female housing 1 so that the rubber ring 6 is sealed to the inner circumferential surface of the receptacle 5 of the male housing 4.

There has been a gradually increasing demand to decrease the size of watertight connectors that have a partial connection detecting function. Accordingly, it has been considered to make such a connector smaller by providing the spring unit 2 in an inwardly retracted position with respect to a radial direction and by deleting the rib 5A. Thus, the spring pressing member 2B would be pushed by an end edge of the receptacle 5. Additionally, an attempt could be made to retract the spring unit 2 to a position where the spring unit 2 overlaps the rubber ring 6 in radial direction. This construction would require the spring unit 2 to be provided behind the mount position of the rubber ring 6, as shown in FIG. 20. However, if the position of the spring unit 2 is displaced backward with respect to a connecting direction, the coil spring 2A can be compressed only after the receptacle 5 of the male housing 4 has been inserted relatively deeply. Thus, the compression of the coil spring 2A that exists when the connecting operation is interrupted halfway may not be sufficient to separate the terminal fittings in the housings 1 and 4 completely. Consequently, an electrical connection test may mistakenly detect that the connectors have been connected properly even though they are connected only partly.

A compression of the coil spring 2A at an early stage of the connecting operation conceivably could avoid the above-described problems. Thus, it may be considered to extend the receptacle 5 of the male housing 4 forward as much as the spring unit 2 is displaced backward. However, such an arrangement makes the entire connector larger in the connecting direction, and therefore is not a realistic option. On the other hand, it may be considered to select a material having a high rigidity for the coil spring 2A. Thus, a spring force that is large enough to separate the housings could be obtained even with a small degree of compression. However, this requires a larger force to connect the housings 1 and 4, thereby adversely affecting the connecting operation. As a result, the prior art does not provide and acceptable solution to the need for a small watertight connector that is capable of detecting an incomplete connection.

In view of the above, it is an object of the present invention to provide an improved connector having reduced overall dimensions but allowing for a good waterproof function.

SUMMARY OF THE INVENTION

The subject invention is directed to a connector that comprises first and second connector housings that are at least partly connectable with each other. The first connector housing comprises a receptacle into which the second connector housing can be fit at least partly. The second connector housing comprises a biasing means for accumulating a biasing force to move the first connector housing away from the second connector housing when the biasing means is compressed elastically by the receptacle as the housings are connected. The connector further comprises a sealing ring, which preferably is mounted securely to the inner circumferential surface of the receptacle for holding the connector housings substantially watertight. The sealing ring is mountable in a temporary mount position located before a proper mount position on the second connector housing with respect to a mating direction of the first connector housing. The sealing ring then is movable to the proper mount position by a moving means provided between or by the connector housings as the connector housings are connected. Additionally, the biasing means is provided behind the sealing ring to radially overlap the sealing ring in the temporary mount position. That is, the biasing means is at least partly at the same radial distance as the sealing ring or is at least partly adjacent the sealing ring.

When the connection of the connector housings is started, the biasing means is pushed by the end edge of the receptacle and is compressed elastically. Additionally, the sealing ring is moved from the temporary mount position toward the proper mount position by the moving means. When the connector housings are connected properly, the sealing ring has been moved to the proper mount position and has been sealed securely to the second connector housing and the inner circumferential surface of the receptacle to provide a stable watertight connection between the connector housings. Here, unless the sealing ring is moved from the temporary mount position, the watertight connection between the connector housings is incomplete even if the connector housings are properly connected.

The biasing means is provided in an inwardly retracted position where it overlaps the sealing ring in a radial direction. Consequently, the radial dimension of the connector can be shortened. An attempt to make the connector smaller causes the biasing means to be behind the rubber ring, and delays the time at which the biasing means is pushed by the receptacle. However, in the subject invention, the biasing means is positioned behind the sealing ring in the temporary mount position, which is more forward than the proper or final mount position of the sealing ring with respect to a depth direction. Consequently, the biasing means can be provided more forward by a distance approximately equal to the distance that the sealing ring is moved. Therefore, the receptacle can start pushing the biasing means at an early stage of the connecting operation.

A sealed space preferably is formed inside the receptacle by or in cooperation with the second connector housing while the connector housings are being connected, and air in the sealed space is compressed to produce an air pressure as the connection progresses. The moving means may comprise or may be formed by the resulting air pressure. Thus, the sealing ring is moved to the proper mount position by the resulting air pressure.

A pushing portion may project from the inner surface of the receptacle for pushing the sealing ring as the connector housings are connected, and the moving means may comprise the pushing portion. Thus, the sealing ring can be moved to the proper mount position by directly pushing the sealing ring with the pushing portion as the connector housings are connected.

As explained above, the moving means preferably is formed by a pressure of air compressed in a sealed space defined inside the receptacle between the second connector housing and a pushing portion on the inner surface of the receptacle. Thus, the air pressure preferably pushes the sealing ring as the connector housings are connected. However, if air should leak from the sealed space, the pushing portion that projects from the inner surface of the receptacle directly pushes the sealing ring. Therefore, the sealing ring can be moved securely to the proper mount position.

The second connector housing preferably is formed to accommodate at least parts of terminal fittings. A retainer preferably is mountable transversely on the second connector housing, and is configured for locking the terminal fittings in the second connector housing. A clearance preferably is formed between an inner surface of the sealing ring and an outer surface of the retainer when the sealing ring is in the temporary mount position. However, the inner surface of the sealing ring preferably is sealed securely to the second connector housing over substantially an entire circumference.

A transversely mounted retainer usually is mounted before a sealing ring to provide a watertight connection. Thus, if an attempt is made to mount the sealing ring as forward as possible, it may be necessary to locate the sealing ring in a position where it overlaps the retainer. In such a position, a clearance may be formed between the sealing ring and the retainer. Then, the sealing ring cannot be secured where the clearance is formed, and an incomplete watertight connection is provided between the connector housings.

If the sealing ring radially overlaps the retainer in its temporary mount position, and is moved to its proper mount position where it is secured to the second connector housing over the entire circumference by properly connecting the connector housings, a stable watertight connection can be achieved between the connector housings.

According to a further preferred embodiment, the connector comprises a biasing means holder mountable in or on the other connector housing for holding the biasing means. A movement range of the biasing means holder may be restricted by the interaction of locking means on the biasing means holder with a mating locking means on the second connector housing.

The biasing means holder may comprise an escape recess for allowing a locking means on one of the connector housings to be deflected when coming into engagement with a mating locking means provided on the other of the connector housings. A portion of the escape recess may be formed to restrict a movement range of the biasing means holder by interacting with the deflected locking means.

These and other objects, features and advantages of the present invention will become apparent upon reading of the following detailed description of preferred embodiments and accompanying drawings.

DETAILED DESCRIPTION OF THE PREFERRED EMBODIMENT

Figure 1:
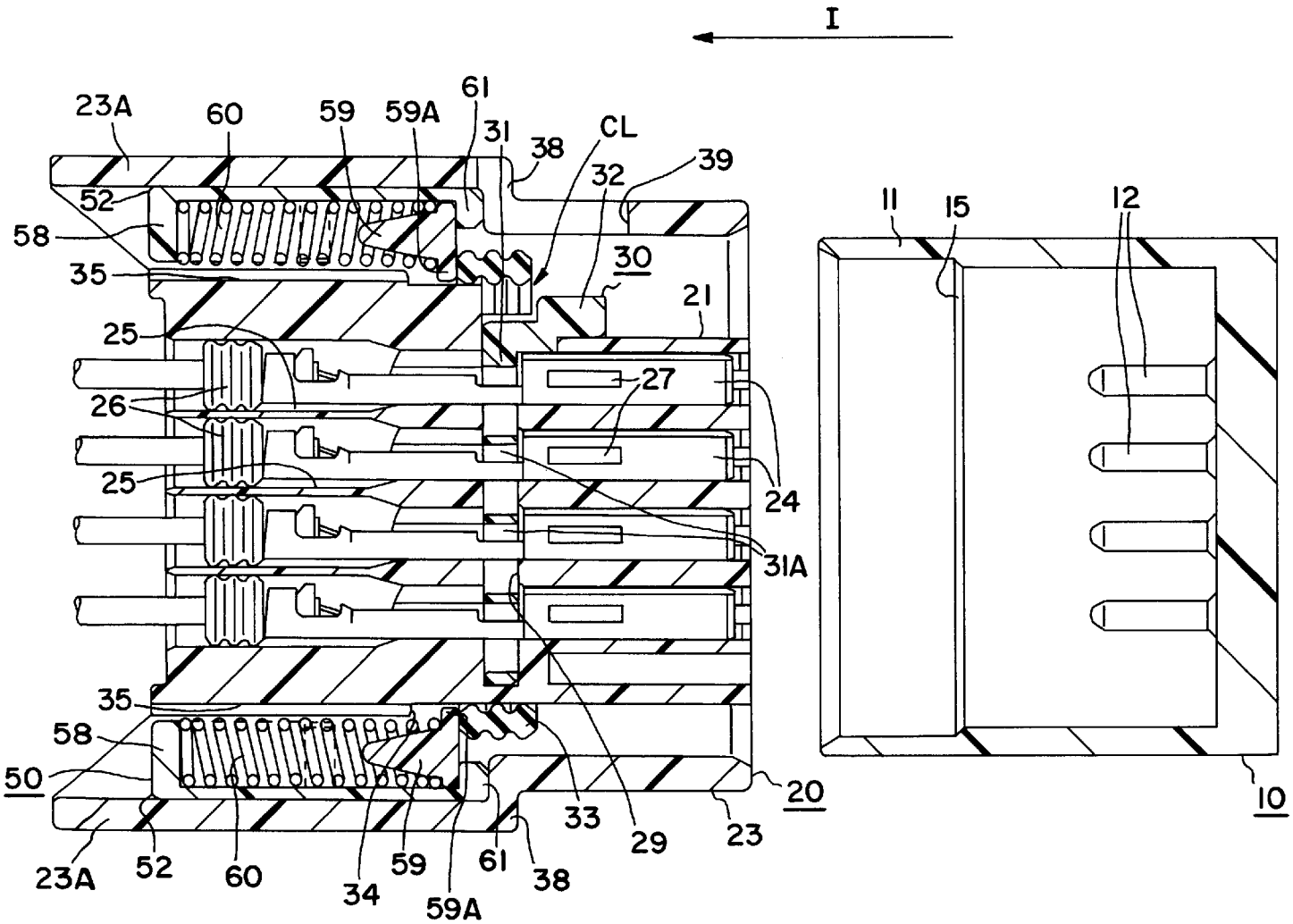
FIG. 1 is an exploded plan view in section of a connector according to one embodiment of the invention.
Figure 2:
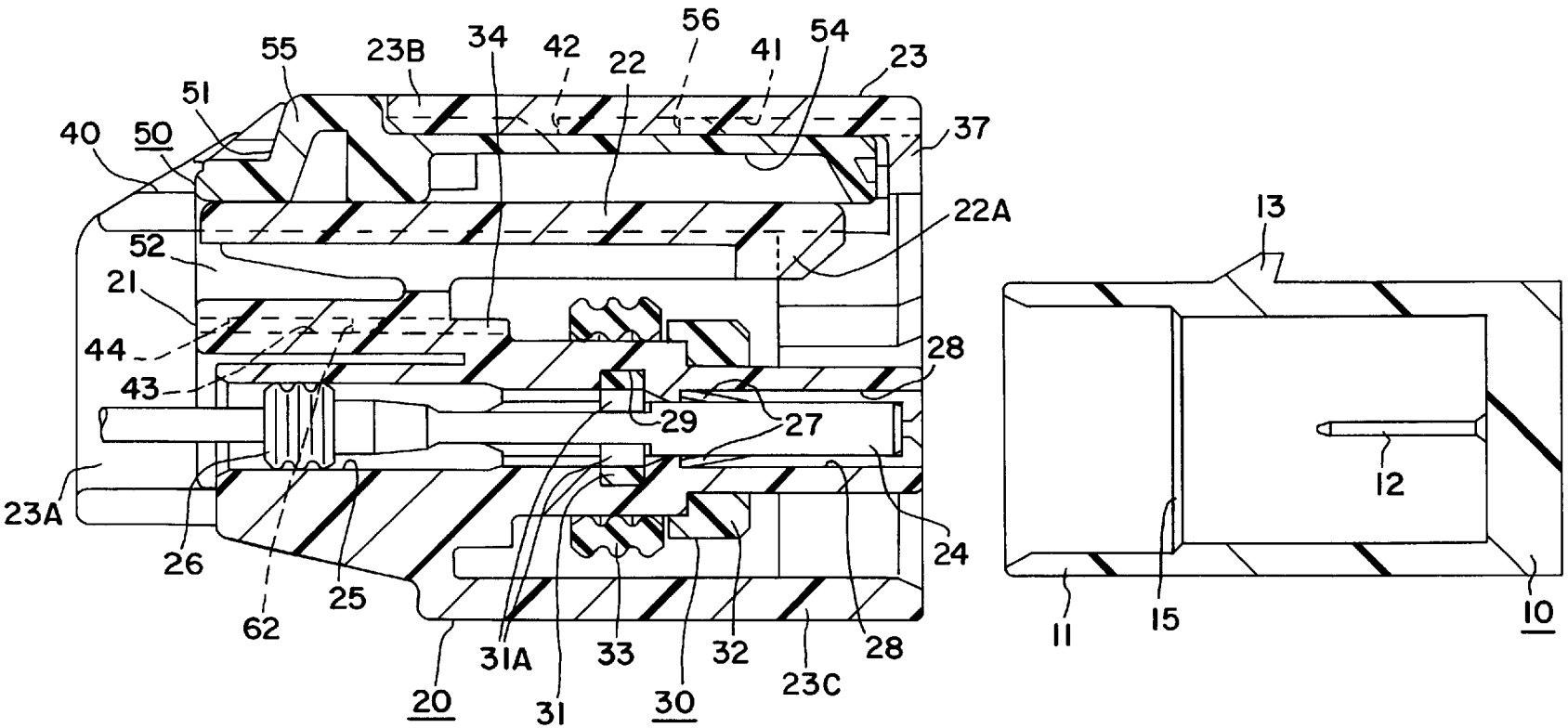
FIG. 2 is an exploded side in section of the connector.

A male connector housing in accordance with the invention is identified generally by the numeral 10 in FIGS. 1 and 2, and a female connector housing is identified generally by the numeral 20. The male and female housings 10 and 20 each have front ends that are at least partly connectable with each other along an inserting or mating direction 1. A spring holder 50 is mountable in the female housing 20 and is provided with coil springs 60.

Figure 3:
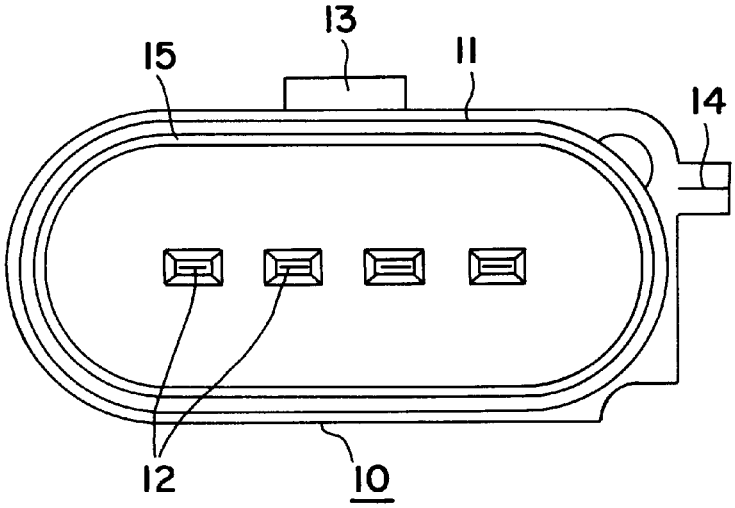
FIG. 3 is a front view of a male housing.

The male housing 10 may be coupled directly to a piece of electrical equipment. As shown in FIG. 1 to 3, four male terminal fittings 12 project substantially side-by-side in a receptacle 11 that is open forwardly and has a substantially flat ring shape. A locking projection 13 with a slanted front surface is provided substantially in the middle of the upper surface of the receptacle 11, and a projection 14 is provided on a right side surface of the receptacle 11, as shown in FIG. 3. The projection 14 prevents an upside-down insertion of the male housing 10 into a female housing 20 during a connection operation.

Figure 4:
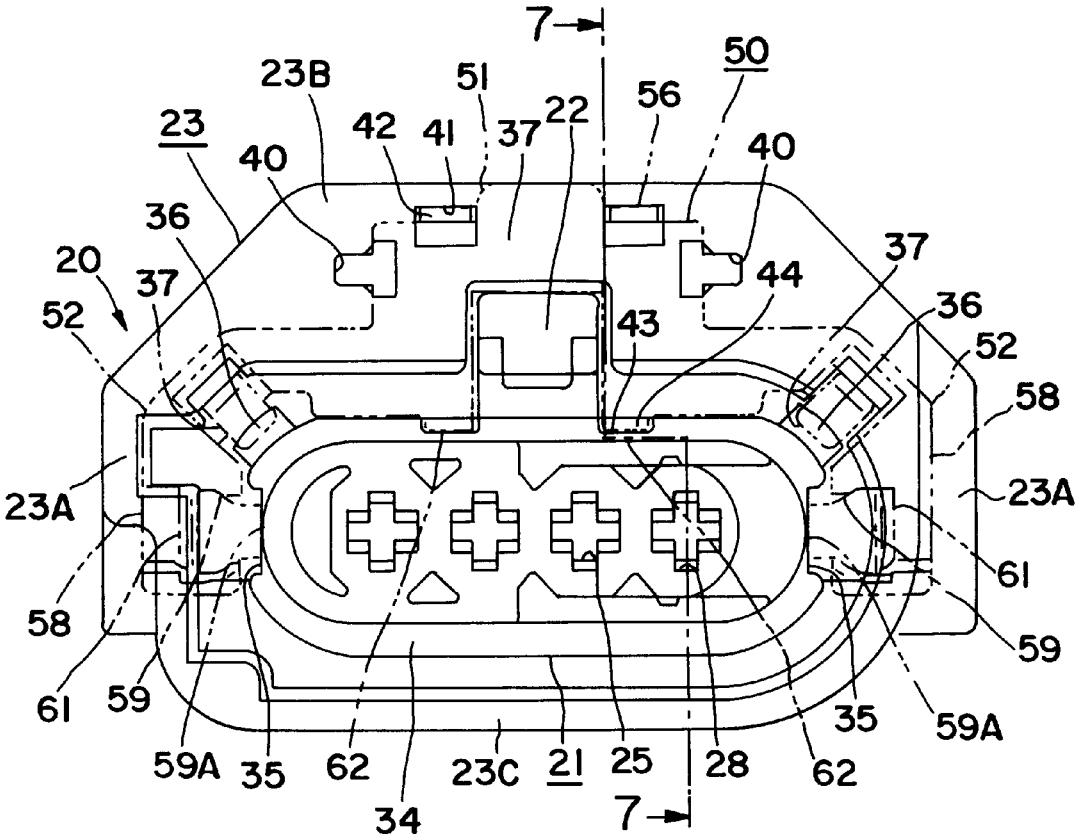
FIG. 4 is a front view of a female housing.

The female housing 20, as shown in FIGS. 1, 2 and 4, is unitarily molded from a nonconductive material, and includes a terminal accommodating portion 21 that accommodates a plurality of female terminal fittings 24. A lock arm 22 is formed unitarily on the upper surface of a terminal accommodating portion 21, and a substantially rectangular outer tubular portion 23 substantially surrounds the terminal accommodating portion 21 and the lock arm 22. The outer tubular portion 23 is hollow in forward and backward directions, and is configured such that the receptacle 11 of the male housing 10 can be inserted into the front of the outer tubular portion 23 and can be fitted at least partly around the terminal accommodating portion 21. The spring holder 50 is mountable into the outer tubular portion 23 from behind.

Four cavities 25 are provided substantially side by side in the terminal accommodating portion 21 for at least partly accommodating the female terminal fittings 24. The insides of the respective cavities 25 are held watertight by waterproof rubber plugs 26 that are mounted on the rear ends of the female terminal fittings 24 and that are secured against the inner surfaces of the rear halves of the cavities 25.

The female terminal fittings 24 are doubly locked in the respective cavities 25. In particular, the female terminal fittings 24 have locking portions 27 that are cut and bent to open in a forward direction, as shown in FIG. 2. Locking groves 28 are formed in the upper and lower walls of the front half of each cavity 25 for engagement respectively with the locking portions 27 of the corresponding female terminal fittings 24. Additionally, a retainer mount groove 29 is formed slightly forward of the longitudinal center of the terminal accommodating portion 21, and a retainer 30 is mounted transversely in the retainer mount groove 29 for redundant locking of the female terminal fittings in the respective cavities 25.

The retainer 30 includes a locking portion 31 to be inserted into the retainer mount groove 29 and a holding portion 32 located before the locking portion 31 for substantially holding or interacting with the outer circumferential surface of the terminal accommodating portion 21. The retainer 30 can be mounted in a full locking position where locking sections 31A of the locking portion 31 engage the female terminal fittings 24 to lock them in the cavities 25. The retainer 30 also can be mounted in a partial locking position displaced in a direction normal to FIG. 1 where the locking sections 31A are retracted from the cavities 25 to permit insertion and withdrawal of the female terminal fittings 24 into and from the cavities 25. The outer circumferential surface of the terminal accommodating portion 21 on which the holding portion 32 is mounted is stepped. Specifically, this surface is recessed at a location slightly before the retainer mount groove 29 and at the right half shown in FIG. 4.

As shown in FIGS. 1 and 2, a rubber ring 33 is provided to achieve a watertight fit between the housings 10 and 20. More particularly, the rubber ring 33 is fitted in the terminal accommodating portion 21 at a position immediately behind the holding portion 32 of the retainer 30 where the retainer mount groove 29 is formed. The rubber ring 33 is held in contact with the holding portion 32 of the retainer 30 as shown in FIG. 2, and thereby is prevented from coming out to the front. When the retainer 30 is located in an unillustrated partial locking position, the outer surface of the locking portion 31 radially overlaps the inner surface of the rubber ring 33 and is held substantially in contact with the inner surface of the rubber ring 33. When the retainer 30 is moved to the full locking position shown in FIG. 1, a clearance CL is formed between the outer surface of the locking portion 31 and the inner surface of the rubber ring 33. The clearance CL has a width corresponding to the moved distance of the retainer 30.

The outer circumferential surface of the terminal accommodating portion 21 at a position spaced slightly backward from the rubber ring 33 is widened outwardly, thereby forming a stepped portion 34 as shown in FIG. 4. The height of the stepped portion 34 is set such that the upper surface of the stepped portion 34 is substantially at the same height as the inner surface of the receptacle 11 of the male housing 10. Accordingly, the receptacle 11 is fitted onto the outer circumferential surface of the stepped portion 34. On the other hand, as shown in FIGS. 1 and 4, groove-shaped recesses 35 are formed in the middle of each of the left and right side surfaces of the stepped portion 34. Spring pressing members 59 of the spring holder 50 are fit at least partly in the recesses 35.

As shown in FIG. 2, the seesaw-shaped elastically deformable lock arm 22 is provided on the upper surface of the terminal accommodating portion 21 behind the stepped portion 34 to extend in longitudinal or forward and backward directions. A hook-shaped locking claw 22A is provided at the front end of the lock arm 22. When the housings 10 and 20 are properly connected, this locking claw 22A is engaged with the locking projection 13 to lock the housings 10 and 20 with each other.

Hooks 36 project obliquely away from the outer circumferential surface of the terminal accommodating portion 21 at the opposite sides of the base end of the lock arm 22 and at the corners of the upper surface of the terminal accommodating portion 21, as shown in FIG. 4. The front ends of the hooks 36 are located substantially at the same position as the base end of the lock arm 22 and the rear end surfaces of the hooks 36 are slanted. The hooks 36 function to catch holding arms 57 of the spring holder 50.

Figure 5:
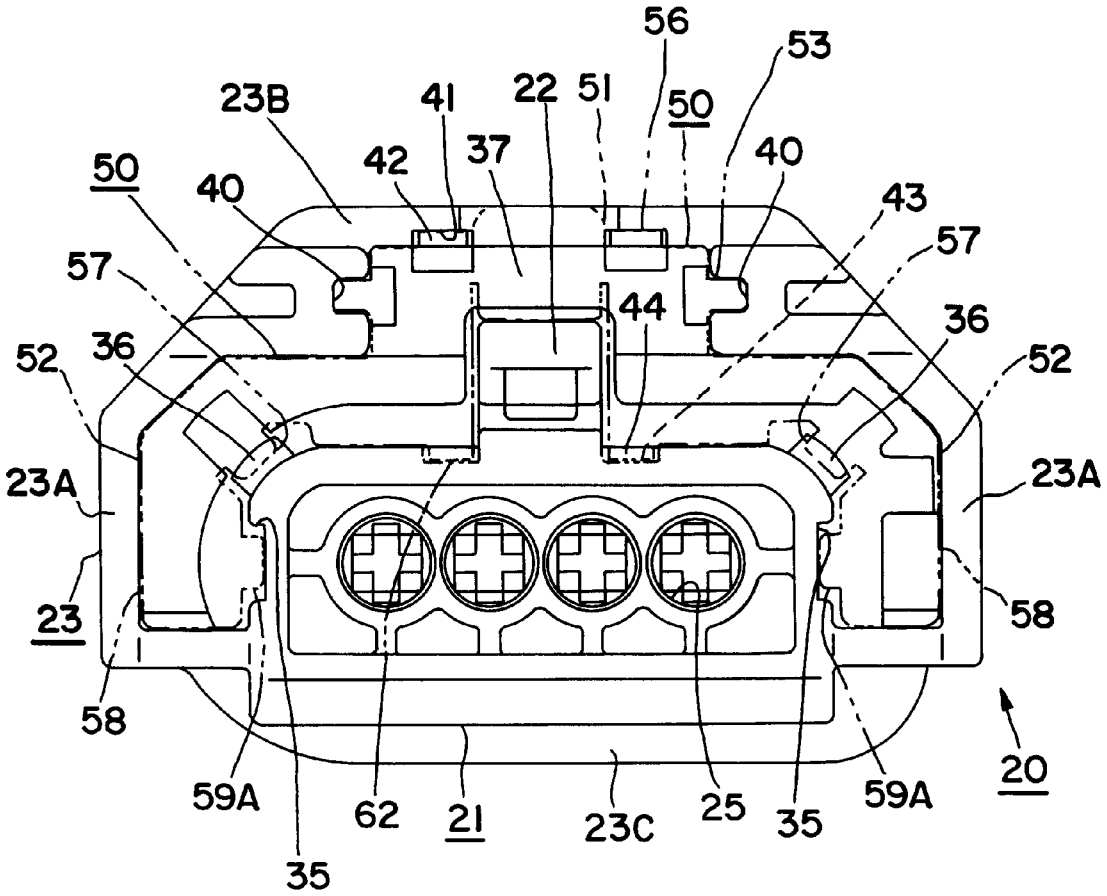
FIG. 5 is a rear view of the female housing.

The outer tubular portion 23 is connected to the bottom surface of the rear part of the terminal accommodating portion 21 and at the rear side of the female housing 20, as shown in FIG. 5. Specifically, left and right bottom parts of the outer tubular portion 23 projecting sideways from the bottom surface of the terminal accommodating portion 21, and side walls 23A project upwardly from outer extremes of the left and right bottom parts of the outer tubular portion 23. The side walls 23A are connected by an upper wall 23B, which is spaced from the lock arm 22 by a specified distance. A substantially gate-shaped space is defined by the upper wall 23B and the side walls 23A and opens to the rear. The spring holder 50 can be mounted through this rear opening.

A section of the outer tubular portion 23 at the front side of the female housing 20 has a substantially ring-shape defined by the upper wall 23B, the side walls 23A and a bottom wall 23C. The bottom wall 23C connects the side walls 23A and projects forward from the bottom wall of the terminal accommodating portion 21, as shown in FIGS. 2 and 4. The receptacle 11 of the male housing 10 can be inserted at least partly into the outer tubular portion 23. Further, as shown in FIG. 2, a front wall 37 hangs down from the front edge of the outer tubular portion 23 to limit forward movement of the spring holder 50. The side walls 23A are spaced more narrowly apart at the front half than at the rear half, thereby forming stepped portions 38. Further, the upper side wall 23A in FIG. 1 is formed with an opening 39 through which the retainer 30 can be mounted on the terminal accommodating portion 21.

Figure 9:
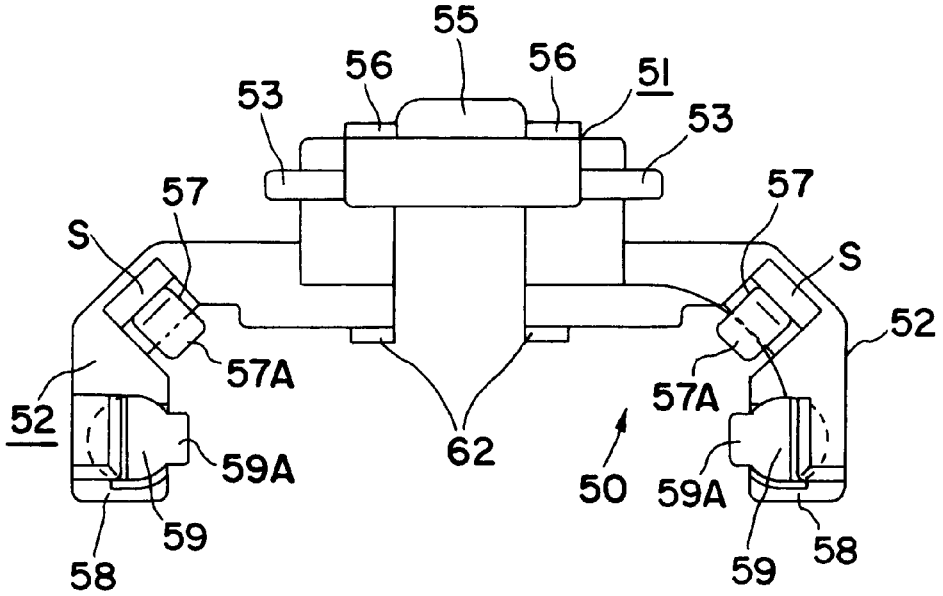
FIG. 9 is a front view of the spring holder.

The spring holder 50 is mounted in the female housing 20 for movement in longitudinal or forward and backward directions as shown in FIGS. 1 and 2. The spring holder 50, as shown in FIG. 9, has a substantially plate-shaped or flat main body 51 and a pair of legs 52 that project down from opposite sides of the bottom surface of the main body 51. The main body 51 of the spring holder 50 is accommodated at least partly between the lock arm 22 and the upper wall 23B of the outer tubular portion 23 in the female housing 20, as shown in FIG. 2. The legs 52 of the spring holder 50 are accommodated at least partly between the terminal accommodating portion 21 and the side walls 23A of the outer tubular portion 23, as shown in FIG. 1.

Figure 11:
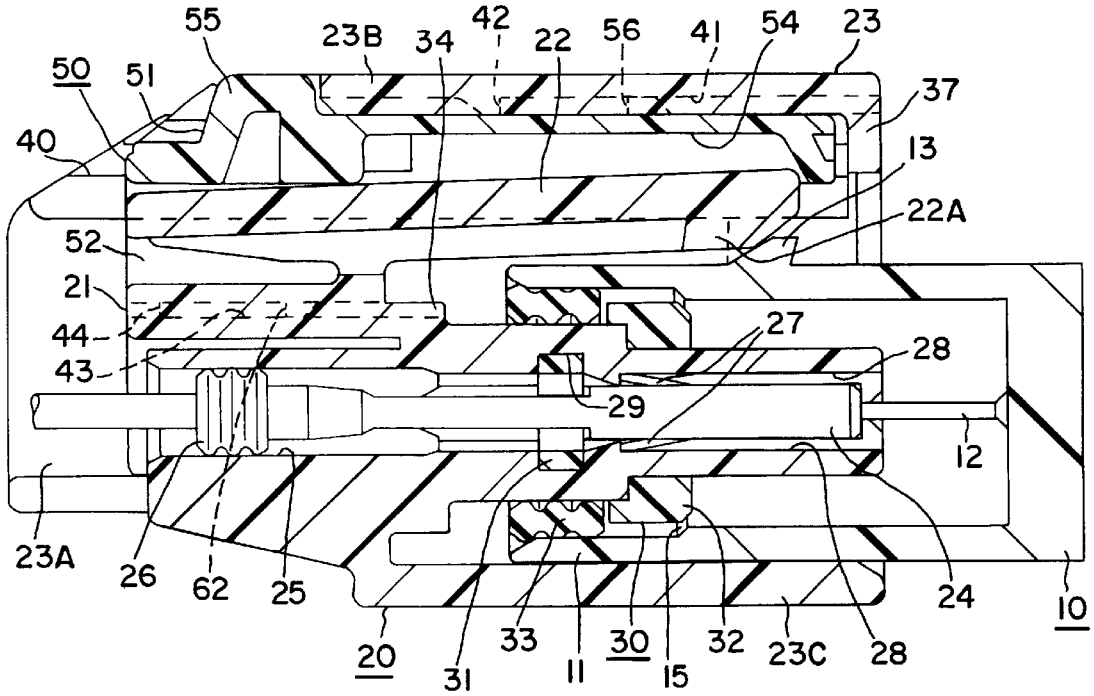
FIG. 11 is a side view in section showing a state where a lock arm has moved onto a locking projection.
Figure 12:
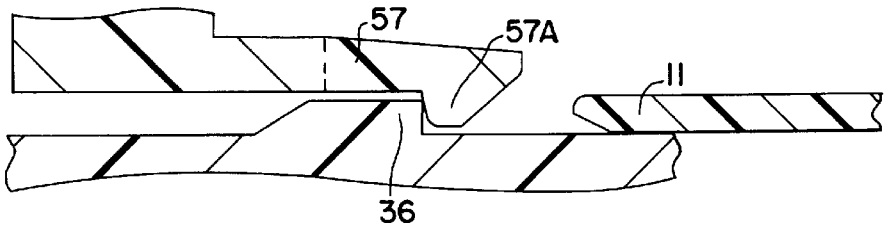
FIG. 12 is a partial enlarged section showing a state where a holding arm is engaged with a hooking projection.
Figure 13:
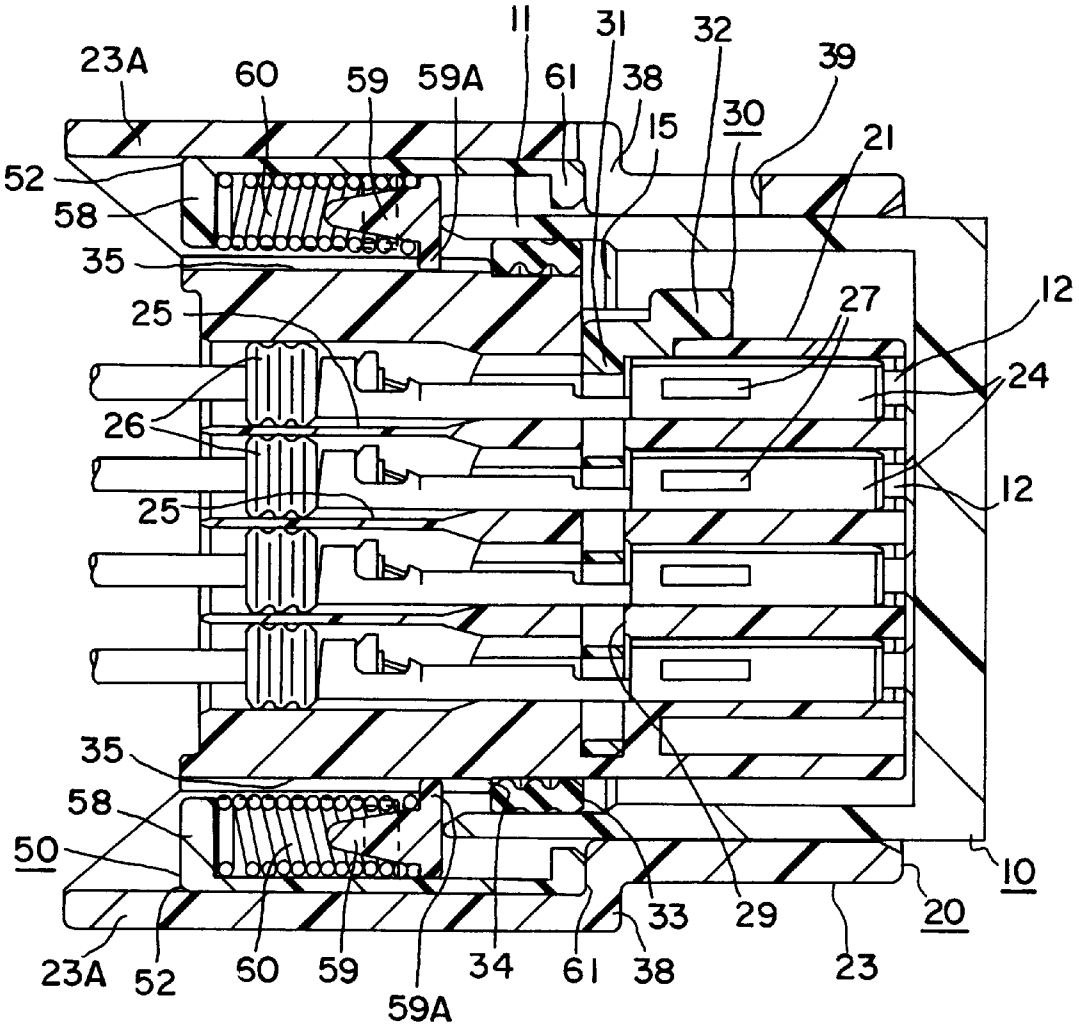
FIG. 13 is a plan view in section showing a state where coil springs are compressed.

A pair of guides 53 project from opposite side surfaces of the main body 51 as shown in FIG. 9. The guides 53 are fitted into guide grooves 40 formed in the side walls 23A of the outer tubular portion 23, as shown in FIG. 5, to guide longitudinal or forward and backward movements of the spring holder 50. The lower surface of the main body 51 is formed with an escape recess 54 to permit an upward substantially elastic deformation of the lock arm 22 away from the male housing 10, as shown in FIG. 2. A backward movement of the spring holder 50 is restricted by the engagement of the front end surface of the elastically deformed lock arm 22 with the front surface of the escape recess 54, as shown in FIG. 11.

Figure 6:
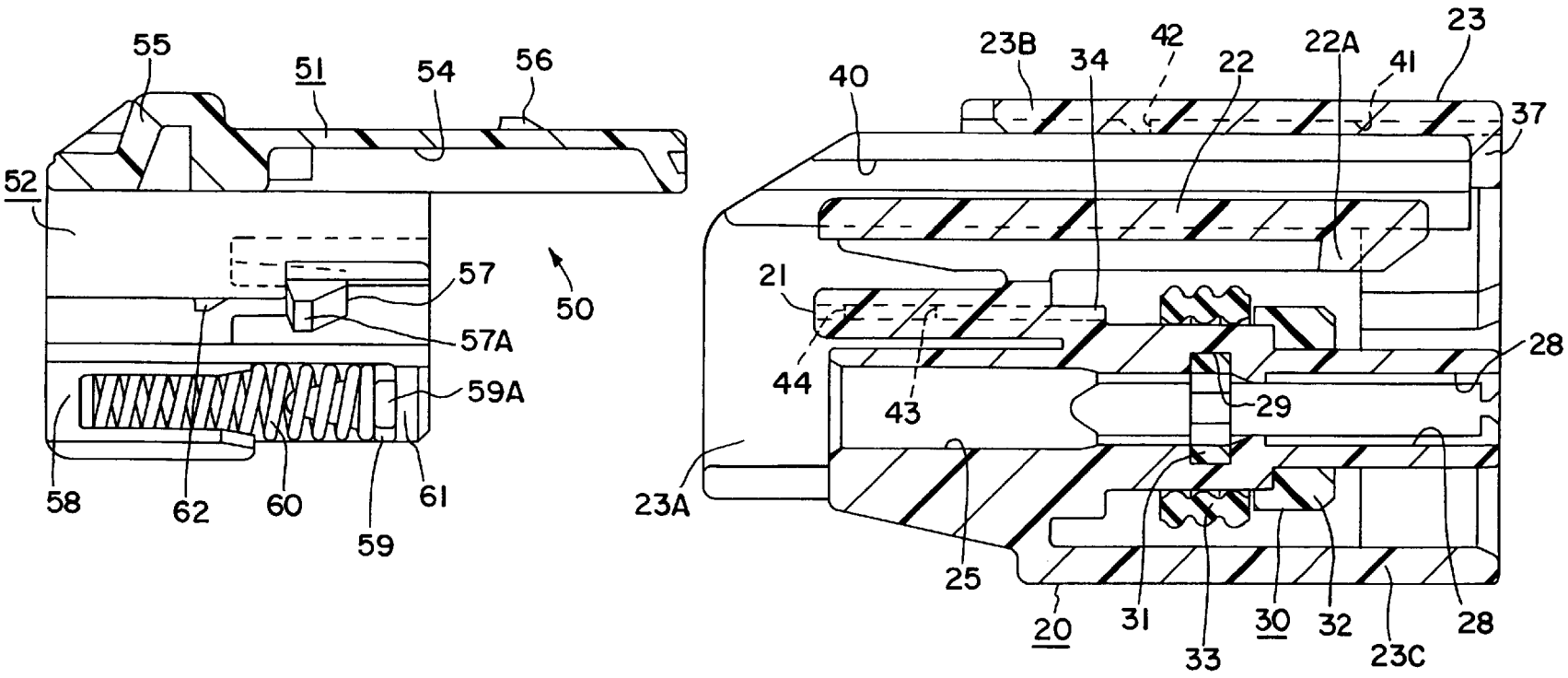
FIG. 6 is a side view in section of the female housing and a spring holder.
Figure 17:
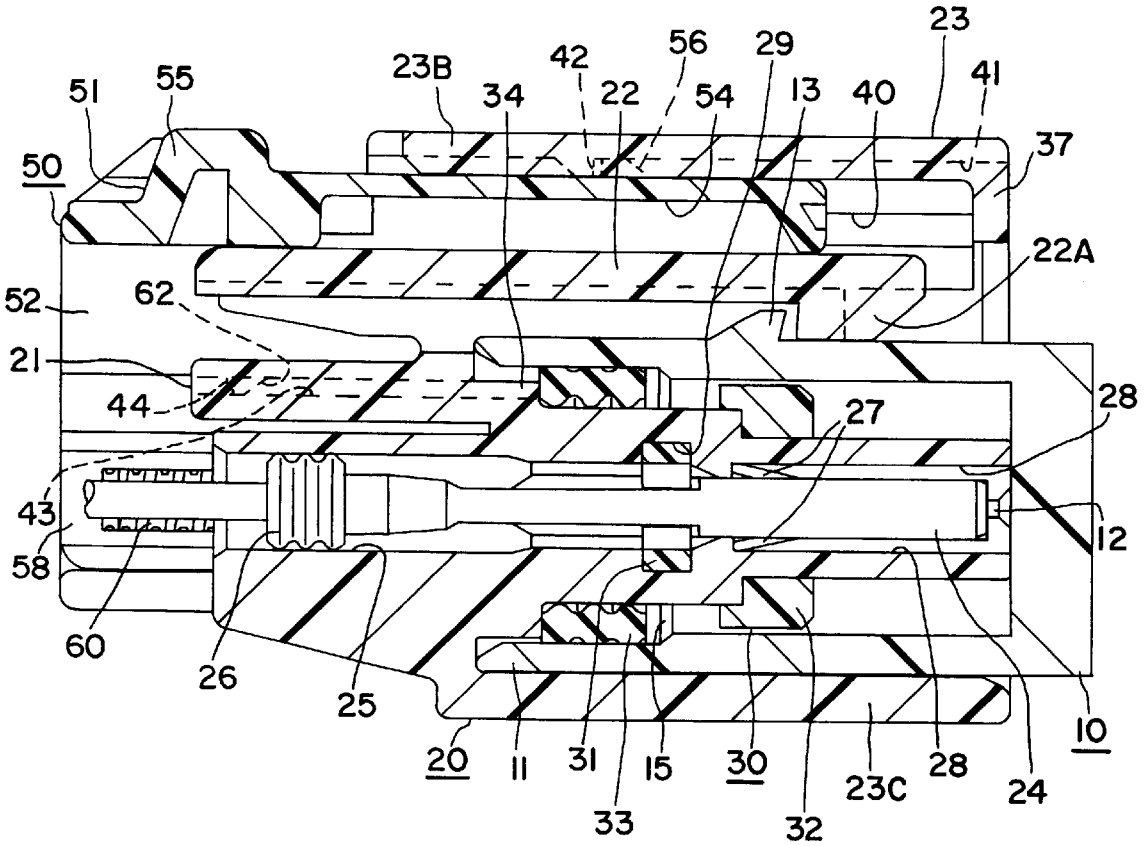
FIG. 17 is a side view in section showing a state where the lock arm is engaged with the locking projection.

An operable portion 55 is provided substantially in the middle of the rear end of the main body 51, and two projections 56 are provided before the operable portion 55, as shown in FIGS. 6 and 9. The projections 56 can be fit at least partly into grooves 41 formed in the inner surface of an upper portion of the outer tubular portion 23, and can be engaged with projections 42 at the rear ends of the grooves 41, to stop a backward movement of the spring holder 50. The projections 56 preferably are positioned such that the rear end of the spring holder 50 is substantially flush with the rear end of the female housing 20 when the spring holder 50 is moved backward, as shown in FIG. 17.

The legs 52 extend from the rear end of the main body 51 to a position slightly forward from the longitudinal center of the main body 51, as shown in FIG. 6. The legs 52 also project transversely from the main body 51 and then bend downward, as shown in FIG. 9.

The elastically deformable holding arm 57 is provided at the inside of the bent portion of each leg 52, and is inclined obliquely. Deformation permitting spaces S are defined obliquely upward from the holding arms 57 for permitting the elastic deformation of the holding arms 57. A hook-shaped locking claw 57A is provided at the front end of each holding arm 57, and a backward movement of the spring holder 50 is restricted by the engagement of the locking claws 57A and the hooks 36 of the terminal accommodating portion 21. An end surface of the receptacle 11 of the male housing 10 that has been fitted from front can contact the front ends of the locking claws 57A. When the receptacle 11 is fitted properly, the receptacle 11 pushes the locking claws 57A up to disengage them from the hooks 36.

A spring accommodating portion 58 is provided at the bottom end of each leg 52. The spring accommodating portion 58 at least partly accommodates the coil spring 60 with the spring pressing member 59 at its front end, as shown in FIG. 6. With reference to FIG. 1, a wall 61 extends from an outer position of the front end of the spring accommodating portion 58 up to a position near the center of the spring pressing member 59. The engagement of the spring pressing member 59 with the wall 61 prevents the coil springs 60 from coming out. The receptacle 11 of the male housing 10 is inserted into the spring accommodating portion 58 from front through open portions that are not covered by the walls 61. Thus, the receptacle 11 pushes the spring members 59 to compress the coil springs 60 while accumulating spring forces therein. A guide projection 59A projects inwardly from each spring pressing member 59, and is fitted at least partly in the corresponding recess 35 of the terminal accommodating portion 21 when the spring pressing member 59 is displaced forward and backward. In this way, movements of the spring members 59 are guided.

Figure 7:
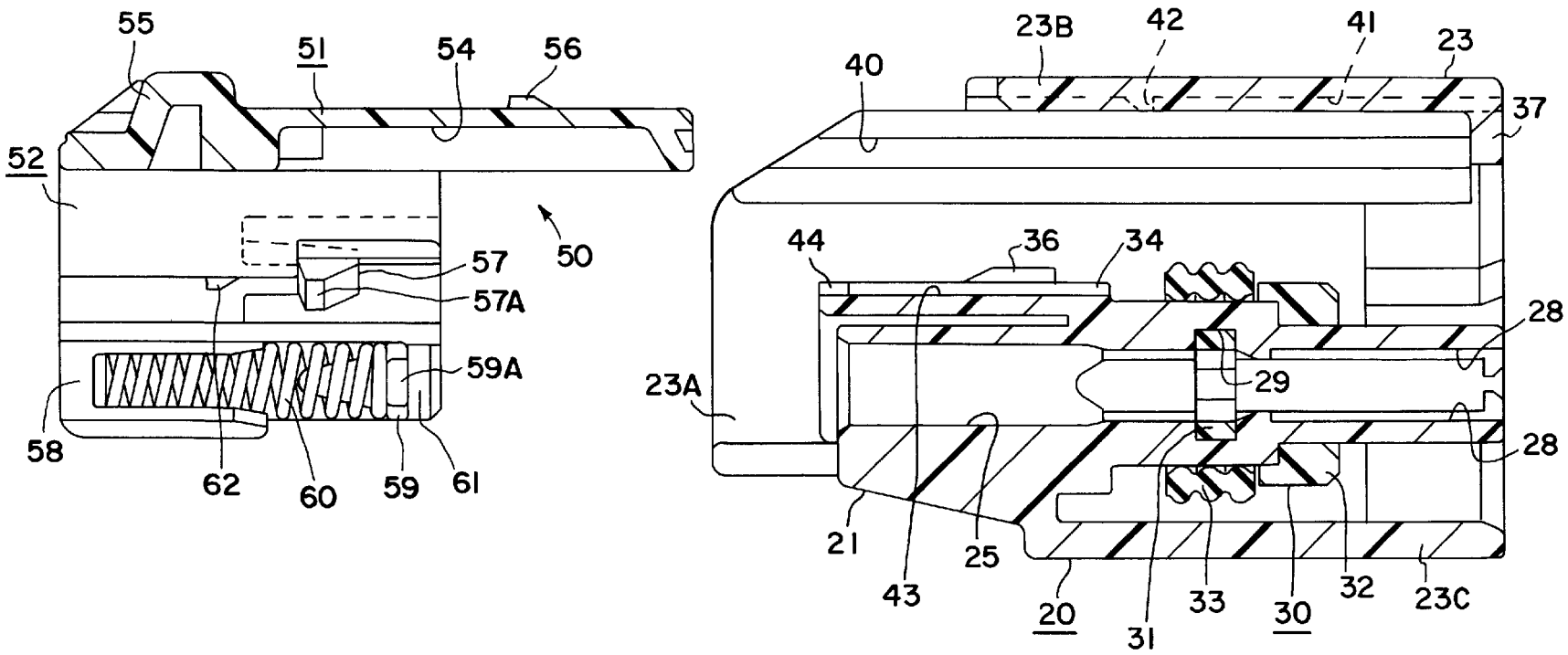
FIG. 7 is a section of the female housing and the spring holder along line 7—7 of FIG. 4.
Figure 8:
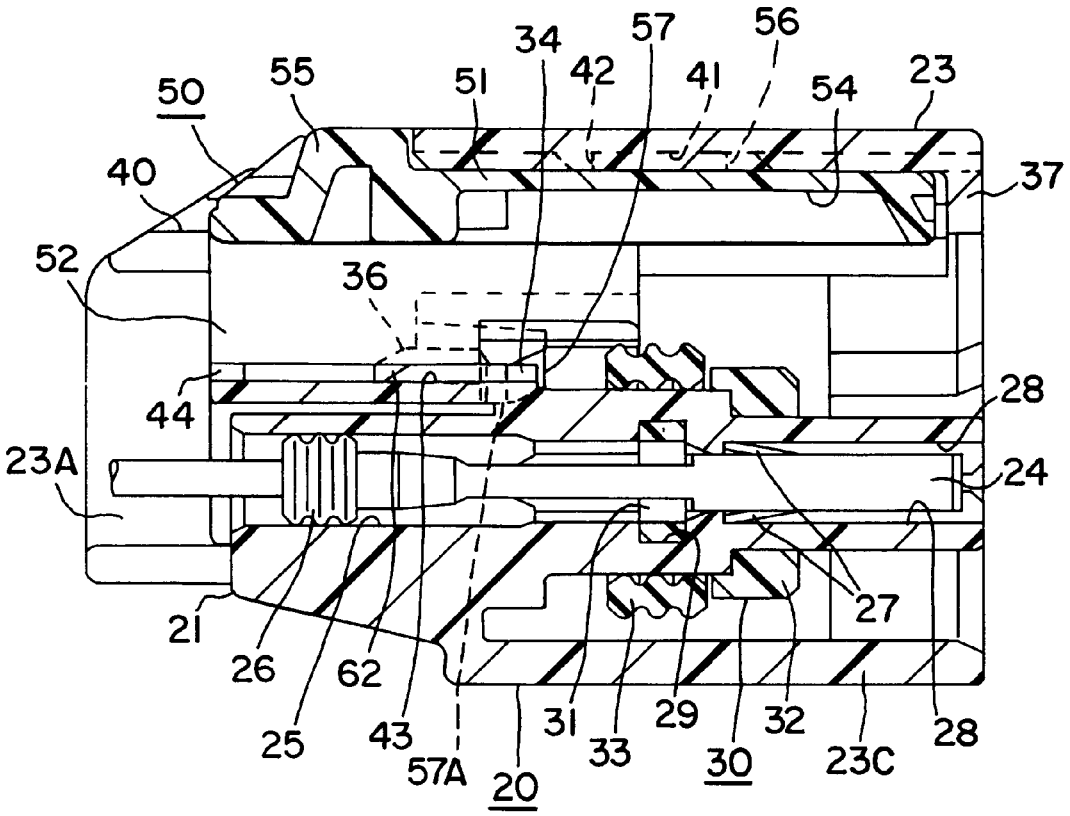
FIG. 8 is a sectional view of the female housing similar to FIG. 7, but having the spring holder mounted therein.

Projections 62 project in positions at the inner sides of the legs 52, as shown in FIG. 9, and behind the holding arms 57, as shown in FIG. 7. The projections 62 stop a backward movement of the spring holder 50, and thus are functionally similar to the projections 56 on the upper surface of the main body 51. The projections 62 can be fit into grooves 43 at the opposite sides of the lock arm 22 on the upper surface of the terminal accommodating portion 21 and can be engaged with projections 44 at the rear ends of the grooves 43.

As shown in FIG. 1, the walls 61 of the spring accommodating portions 58 abut against the stepped portions 38 formed on the side walls 23A of the outer tubular portion 23. The spring members 59 in the spring accommodating portion 58 have their guide projections 59A held substantially in contact with the side surfaces of the terminal accommodating portion 21, and the front surfaces are held in contact with the rear surface of the rubber ring 33. Thus, the spring members 59, the coil springs 60 and the rubber ring 33 are arranged to overlap each other in the radial directions of the female housing 20. Stated differently, the spring members 59, the coil springs 60 and the rubber ring 33 are provided at least partly at the same radial distance from a center axis of the connector or with respect to a mating or inserting direction I of the housings 10 and 20 or are radially adjacent.

Specifically, outer peripheral portions of the front surface of the spring members 59 are held substantially in contact with the walls 61 of the spring accommodating portions 58, the sides of their front surfaces toward the spring members 59A are held substantially in contact with the rubber ring 33, and center portions of their front surfaces are exposed to the front between the walls 61 and the rubber ring 33. The spring members 59 have these exposed center portions of their front surfaces pushed by the end surface of the receptacle 11 to be inserted from the front.

Figure 16:
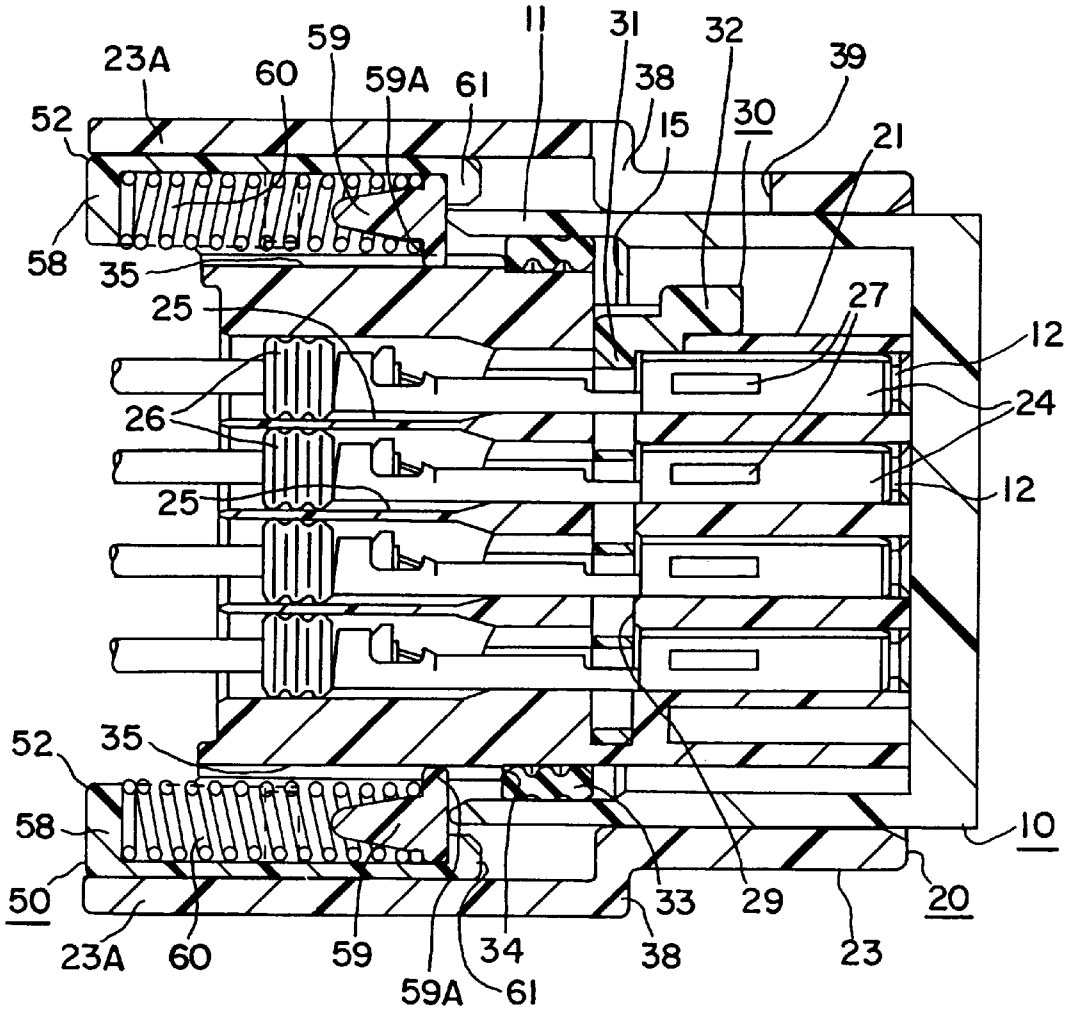
FIG. 16 is a plan view in section showing a state where the housings are properly connected to move the spring holder.

The rubber ring 33 is mounted in its temporary mount position behind the holding portion 32 of the retainer 30 where it overlaps the retainer mount groove 29. In this temporary mount position, there is a clearance between the rubber ring 33 and the outer surface of the locking portion 31, as described above. Additionally, the rubber ring 33 is mounted loosely to the outer circumferential surface of the terminal accommodating portion 21. As a result, an incomplete watertight engagement exists. However, the rubber ring 33 is moved backward from its temporary mount position as the housings 10 and 20 become fully connected. After this movement, the rubber ring 33 is in a proper mount position immediately behind the retainer mount groove 29 where the rubber ring 33 is secured completely to the outer circumferential surface of the terminal accommodating portion 21 over an entire circumference, as shown in FIG. 16. The rear surface of the rubber ring 33 abuts against the recesses 35 of the terminal accommodating portion 21 in this proper mount position. Movement of the rubber ring 33 to the proper and final mount position secures a stable and watertight fit between the housings 10 and 20.

A pushing portion 15 projects inwardly from the inner surface of the receptacle 11 of the male housing 10 in a position located backward from the front end of the receptacle 11 by a specified distance. Additionally, the pushing portion 15 extends around the entire inner circumference of the receptacle 11. The pushing portion 15 is brought directly into contact with the front surface of the rubber ring 33 and pushes the rubber ring 33 to its proper mount position as the housings 10 and 20 are connected.

An early stage of the engagement of the housings 10 and 20 brings the rubber ring 33 into contact with the leading end of the inner surface of the receptacle 11 of the male housing 10. Additionally, the locking claw 22A of the lock arm 22 contacts the locking projection 13 above the receptacle 11. As a result, the lock arm 22 is moved onto the locking projection 13 and is deformed elastically upward or away from the receptacle 11, as shown in FIG. 11. The deformed lock arm 22 enters the escape recess 54 of the main body 51 of the spring holder 50, and the front end surface of the locking claw 22A contacts the front surface of the escape recess 54 to restrict backward movement of the spring holder 50. Backward movement of the spring holder 50 also is restricted by the engagement of the holding arms 57 of the spring holder 50 with the hooks 36 of the terminal accommodating portion 21.

Figure 10:
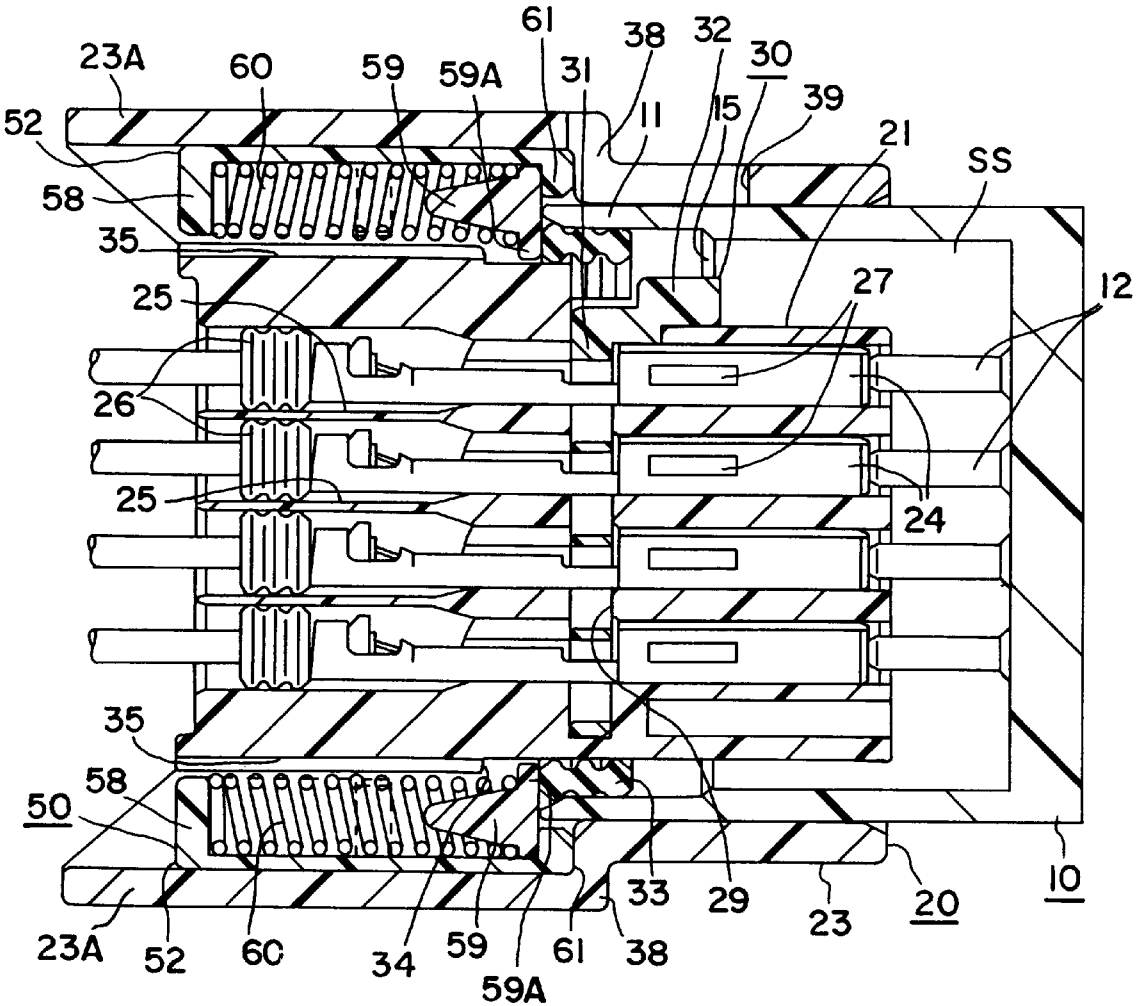
FIG. 10 is a plan view in section showing a state where a receptacle is in contact with spring pressing members.

As shown in FIG. 10, the end surface of the receptacle 11 contacts the center portions of the spring pressing members 59. At this time, the rubber plugs 26 seal the cavities 25 of the female housing 20, and the rubber ring 33 provides a watertight seal between the housings 10 and 20. Accordingly, a sealed space SS is enclosed by the receptacle 11. At this stage, the leading ends of the male terminal fittings 12 are slightly in contact with the female terminal fittings 24. If the connecting operation proceeds further from this state, the end surface of the receptacle 11 pushes the spring members 59 to compress the coil springs 60 and/or air in the sealed space SS. The resulting air pressure will move the rubber ring 33 backward from its temporary mount position.

Figure 14:
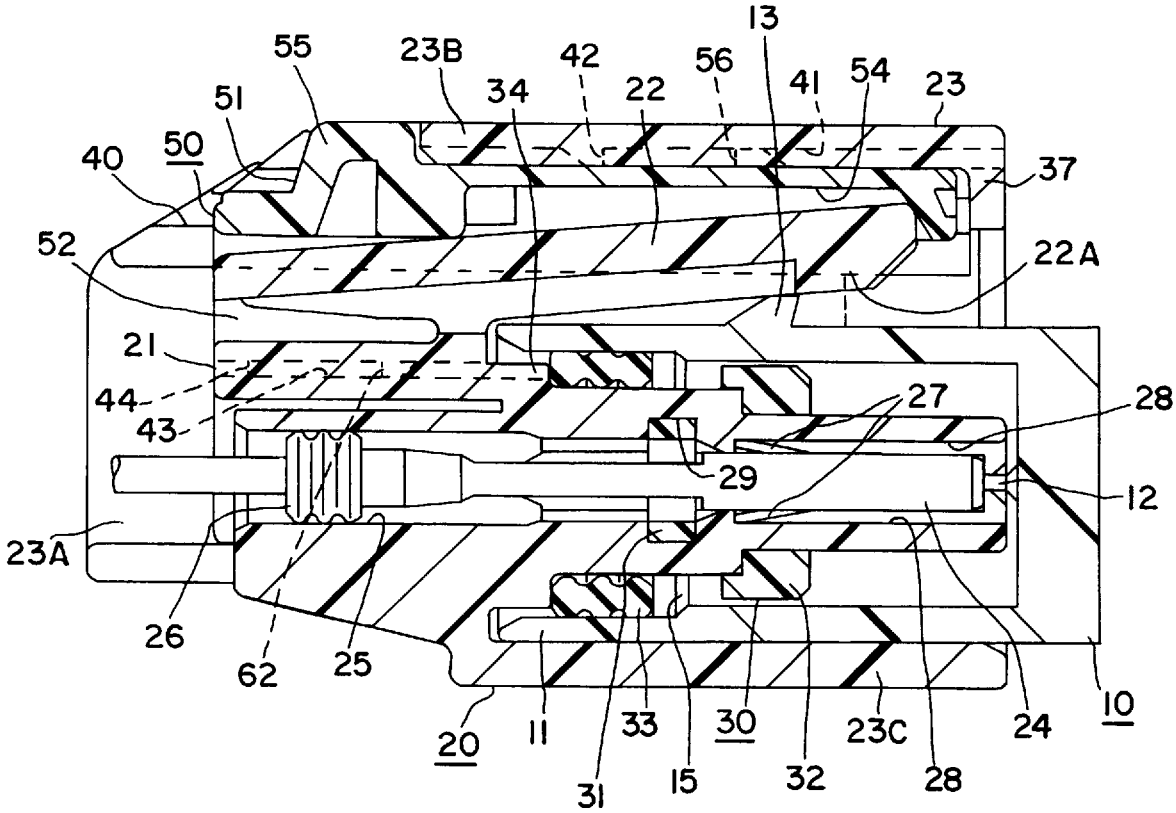
FIG. 14 is a side view in section showing a state immediately before the lock arm is engaged with the locking projection.
Figure 15:
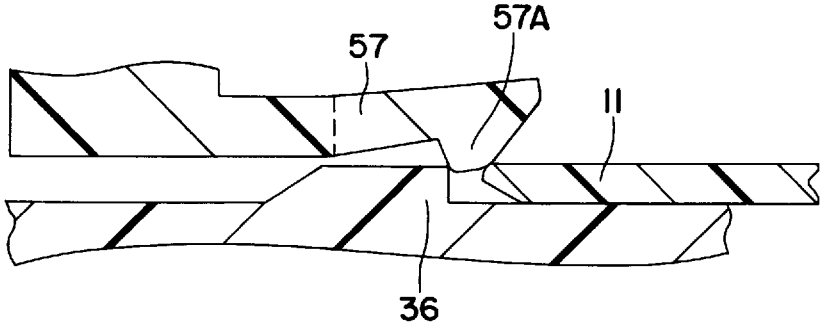
FIG. 15 is a partial enlarged section showing a state where the holding arm is caused to undergo an elastic deformation by a receptacle.

The lock arm 22 is moved completely onto the locking projection 13 to increase its angle of inclination further, as shown in FIG. 14. On the other hand, as shown in FIG. 15, the front end surfaces of the locking claws 57A of the holding arms 57 contact the end surface of the receptacle 11 and the locking claws 57A are raised. As a result, the holding arms 57 are deformed elastically. At this stage, the locking claws 57A still are engaged with the hooks 36, although to a reduced degree. Consequently, backward movement of the spring holder 50 still is restricted doubly.

As explained above, the receptacle 11 already has compressed the coil springs 60 when the housings 10 and 20 are in a partly connected condition. If the connecting operation should be interrupted with the housings 10 and 20 partly connected, the spring forces accumulated in the compressed coil springs 60 are released to separate the housings 10 and 20. This separation of the housings 10 and 20 provides a clear indication of a partial connection. Here, as shown in FIGS. 10 and 11, the male terminal fittings 12 and the female terminal fittings 24 are engaged with each other only to a relatively small degree when the receptacle 11 contacts the spring members 59. Since the compression of the coil springs 60 can be started at an early stage of the connecting operation, the coil springs 60 can be compressed sufficiently when the housings 10 and 20 are connected partly, so that the housings 10 and 20 are pulled apart to positions where the terminal fittings 12 and 24 are separated completely from each other.

Figure 18:
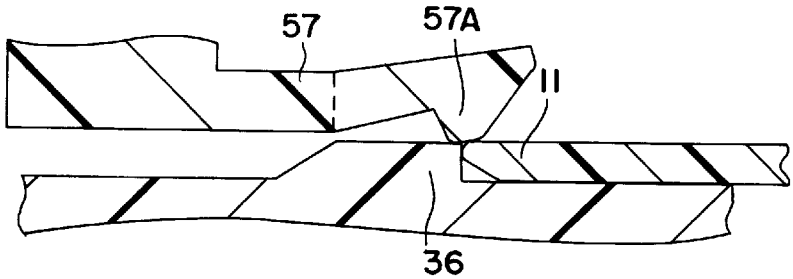
FIG. 18 is a partial enlarged section showing a state of the holding arm completely moved onto the receptacle.
Figure 19:
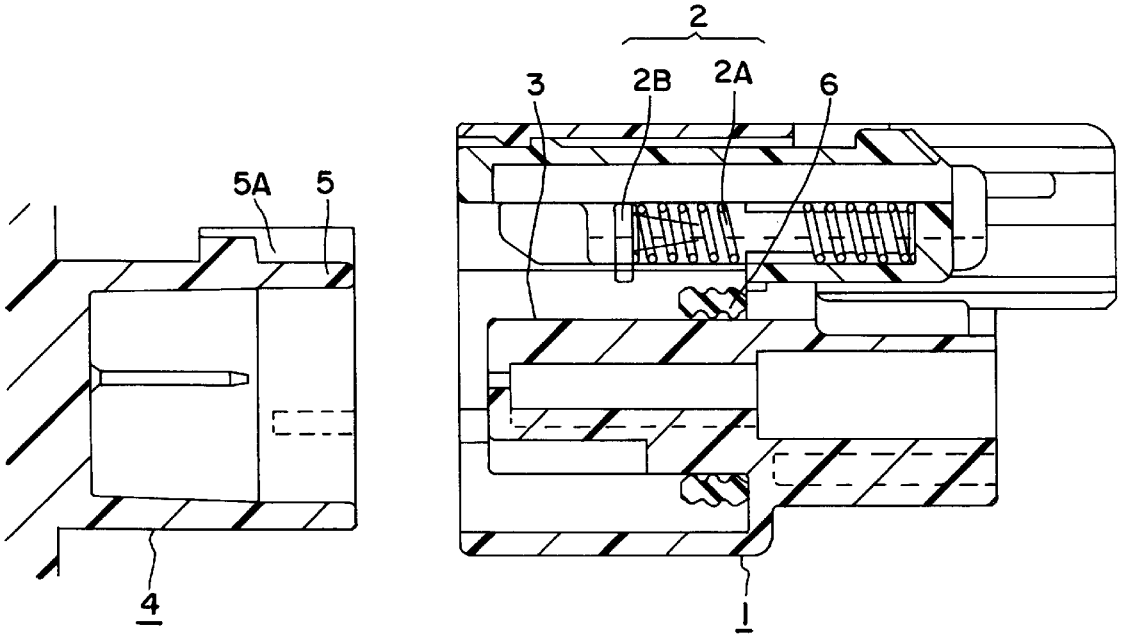
FIG. 19 PRIOR ART
FIG. 19 is a side view in section showing a prior art connector.
Figure 20:
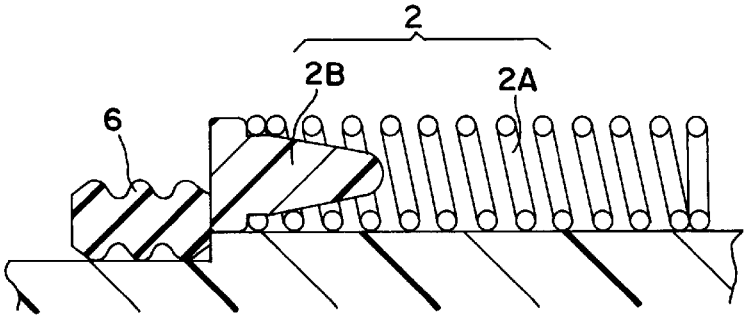
FIG. 20 PRIOR ART
FIG. 20 is a diagram showing a state where a spring unit is retracted up to a position where it overlaps a rubber ring in radial direction.

When the housings 10 and 20 are connected properly, the locking claws 57A of the holding arms 57 are moved completely onto the upper surface of the receptacle 11, as shown in FIG. 18, and thereby are disengaged from the hooks 36. Substantially simultaneously, the locking claw 22A of the lock arm 22 moves over the locking projection 13. Thus, the lock arm 22 is restored elastically to its original shape and engages the locking projection 13, as shown in FIG. 17, to lock the housings 10 and 20 together. As the lock arm 22 is restored elastically, the front end surface of the locking claw 22A is disengaged from the front surface of the escape recess 54 of the spring holder 50 to effect unlocking. In this way, the restriction on the backward movement of the spring holder 50 by the holding arms 57 and the lock arm 22 is released.

Spring forces accumulated in the compressed coil springs 60 then are released, and the spring holder 50 is moved backward, as shown in FIG. 16. As the spring holder 50 moves, the projections 56 on the upper surface of the main body 51 of the spring holder 50 and the projections 62 on the lower surfaces of the legs 52 slide along the grooves 41, 43 of the female housing 20, and contact the projections 42, 44 at the rear ends of the grooves 41, 43, respectively, thereby stopping the backward movement of the spring holder 50 and preventing the spring holder 50 from coming out of the female housing 20. At this stage, the rubber ring 33 is moved to its proper mount position, and any further backward movement of the rubber ring 33 is restricted by the contact with the stepped portions 34. Thus the rubber ring 33 is sealed completely to the outer circumferential surface of the terminal accommodating portion 21 and the inner circumferential surface of the receptacle 11 to provide a stable watertight fit between the housings 10 and 20.

At this time, the coil springs 60 are returned to their natural lengths, as shown in FIG. 16, and hence no force acts to separate the properly connected housings 10 and 20. Further, the front part of the escape recess 54 in the main body 51 of the backwardly-moved spring holder 50 is located above the lock arm 22 and presses the lock arm 22, as shown in FIG. 17. Thus, upward elastic deformation of the lock arm 22 is restricted, and, as a result, the locking projection 13 is locked doubly to the housings 10, 20 connected with an improved force.

If the sealed space enclosed by the receptacle 11 leaks, there may not be sufficient air pressure to move the rubber ring 33 to its proper mount position. In such a case, the rubber ring 33 is moved to its proper mount position by direct pushing forces exerted by the pushing portion 15 that projects from the inner circumferential surface of the receptacle 11.

As described above, the connector of the subject invention can be made smaller by overlapping the rubber ring 33, the coil springs 60 and the spring members 59 in the radial directions of the female housing 20. Further, the rubber ring 33 is moved from the temporary mount position to the proper mount position where the rubber ring 33 displays a stable water preventing function as the housings 10 and 20 are connected. Thus, the receptacle 11 can start pushing the spring members 59 as much as the rubber ring 33 is moved at an early stage of the operation of connecting the housings 10, 20. Furthermore, since the center portions of the spring members 59 can be pushed by the end surface of the receptacle 11, the coil springs 60 can be compressed stably.

The present invention is not limited to the above described and illustrated embodiment. For example, following embodiments also are embraced by the technical scope of the invention as defined in the claims. Besides these embodiments, various changes can be made without departing from the scope and spirit of the invention as defined in the claims.

Although the pushing portion is provided to securely push the rubber ring to its proper mount position in the foregoing embodiment, it may not necessarily be provided.

The rubber ring may be moved, for example, by the pushing portion without depending on the air pressure as described in the foregoing embodiment.

What is claimed is:

1. A connector, comprising:

first and second connector housings at least partly connectable with each other, the first connector housing comprising a receptacle to which the second connector housing is at least partly fiftable, and the second connector housing comprising a biasing member disposed for being elastically compressed by the receptacle as the connector housings are connected and for accumulating a biasing force to urge the connector housings away from each other, and a sealing ring disposed for secure engagement against an inner circumferential surface of the receptacle to hold the connector housings substantially watertight, the sealing ring being mountable in a temporary mount position located before a proper mount position on the second connector housing with respect to an inserting direction of the first connector housing and a moving means provided between the connector housings for moving the sealing ring to a proper mount position as the connector housings are connected, the biasing member being provided behind the sealing ring relative to the inserting direction, and the biasing member being disposed such that portions of the biasing member align with portions of the sealing ring along the inserting direction, a sealed space being formed inside the receptacle between the connector housings while the connector housings are being connected, a moving means comprising air in the sealed space that is compressed to produce an air pressure as the connection progresses.

2. A connector according to claim 1, wherein the moving means further comprises a pushing portion for pushing the sealing ring as the connector housings are connected, the pushing portion projecting from an inner surface of the receptacle.

3. A connector according to claim 1, wherein the second connector housing is formed to at least partly accommodate terminal fittings, a retainer for locking the terminal fittings being mountable transversely on the second connector housing, and a clearance being formed between an inner surface of the sealing ring and an outer surface of the retainer when the sealing ring is in the temporary mount position while the inner surface of the sealing ring is secured to the second connector housing over substantially an entire circumference.

4. A connector according to claim 3, wherein the sealing ring is provided in overlapping relationship with the retainer in the temporary mount position, and wherein the sealing ring is spaced from the retainer in the properly mounted position.

5. A connector according to claim 4, wherein the biasing member and the sealing ring abut in the temporary mount position.

6. A connector according to claim 1, further comprising a biasing member holder mountable in or on the second connector housing for holding the biasing member.

7. A connector according to claim 6, wherein a movement range of the biasing member holder is restricted by interaction of locking member on the biasing member holder with mating locking member on the second connector housing.

8. A connector according to claim 7, wherein the biasing member holder comprises an escape recess for allowing a locking member provided on the first connector housing to be deflected when coming into engagement with a mating locking member provided on the second connector housing.

9. A connector according to claim 8, wherein a portion of the escape recess is formed to restrict a movement range of the biasing member holder by interacting with the deflected locking means.

10. A connector, comprising:

first and second connector housings at least partly connectable with each other, the first connector housing comprising a receptacle to which the second connector housing is at least partly fittable, and the second connector housing comprising a biasing member disposed for being elastically compressed by the receptacle as the connector housings are connected and for accumulating a biasing force to urge the connector housings away from each other, and a sealing ring disposed for secure engagement against an inner circumferential surface of the receptacle to hold the connector housings substantially watertight, the sealing ring being mountable in a temporary mount position located before a proper mount position on the second connector housing with respect to an inserting direction of the first connector housing and a moving means provided between the connector housings for moving the sealing ring to a proper mount position as the connector housings are connected, the biasing member being provided behind the sealing ring relative to the inserting direction, and the biasing member being disposed such that portions of the biasing member align with portions of the sealing ring along the inserting direction, the second connector housing being formed to at least partly accommodate terminal fittings, a retainer for locking the terminal fittings being mountable transversely on the second connector housing, a clearance being formed between an inner surface of the sealing ring and an outer surface of the retainer when the sealing ring is in the temporary mount position and when the inner surface of the sealing ring is secured to the second connector housing over substantially an entire circumference, the sealing ring being provided in overlapping relationship with the retainer in the temporary mount position and abutting the biasing member in the temporary mount position, the sealing ring being spaced from the retainer in the proper mount position.

* * * * *